US011158452B2

(12) United States Patent
Inaba

(10) Patent No.: US 11,158,452 B2
(45) Date of Patent: Oct. 26, 2021

(54) REACTOR

(71) Applicants: AUTONETWORKS TECHNOLOGIES, LTD., Yokkaichi (JP); SUMITOMO WIRING SYSTEMS, LIMITED, Yokkaichi (JP); SUMITOMO ELECTRIC INDUSTRIES, LTD., Osaka (JP)

(72) Inventor: Kazuhiro Inaba, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 706 days.

(21) Appl. No.: 16/069,629

(22) PCT Filed: Jan. 20, 2017

(86) PCT No.: PCT/JP2017/002034
§ 371 (c)(1),
(2) Date: Jul. 12, 2018

(87) PCT Pub. No.: WO2017/130874
PCT Pub. Date: Aug. 3, 2017

(65) Prior Publication Data

US 2019/0013144 A1 Jan. 10, 2019

(30) Foreign Application Priority Data

Jan. 27, 2016 (JP) ..... JP2016-013754

(51) Int. Cl.
*H01F 27/04* (2006.01)
*H01F 27/30* (2006.01)
(Continued)

(52) U.S. Cl.
CPC ..... *H01F 27/30* (2013.01); *H01F 27/02* (2013.01); *H01F 27/24* (2013.01); *H01F 27/402* (2013.01);
(Continued)

(58) Field of Classification Search
CPC ..... H01F 27/30; H01F 37/00; H01F 27/02; H01F 27/24; H01F 27/402; H01F 2027/406
(Continued)

(56) References Cited

U.S. PATENT DOCUMENTS

2010/0226410 A1* 9/2010 Maeno ..... H01F 27/402 374/208
2011/0156853 A1* 6/2011 Kato ..... H01F 27/306 336/192
(Continued)

FOREIGN PATENT DOCUMENTS

JP S50-090144 U 7/1975
JP S52-040336 Y2 9/1977
(Continued)

OTHER PUBLICATIONS

Apr. 18, 2017 International Search Report issued in Patent Application No. PCT/JP2017/002034.

*Primary Examiner* — Shawki S Ismail
*Assistant Examiner* — Kazi S Hossain
(74) *Attorney, Agent, or Firm* — Oliff PLC

(57) ABSTRACT

Provided is a reactor including: an assembly that has a coil that has a pair of winding portions that are arranged side by side, and a magnetic core; a base member that has a mount plate on which the assembly is mounted; and a sensor assembly that has a sensor main body that detects a physical value related to the reactor, and a wiring portion extending from the sensor main body. The reactor includes a wire catch
(Continued)

member provided on the assembly or the base member, the wire catch member allowing a part of the wiring portion to be arranged thereon, and a cable tie for fixing the wiring portion to the wire catch member.

4 Claims, 10 Drawing Sheets

(51) Int. Cl.
*H01F 37/00* (2006.01)
*H01F 27/02* (2006.01)
*H01F 27/24* (2006.01)
*H01F 27/40* (2006.01)

(52) U.S. Cl.
CPC ..... *H01F 37/00* (2013.01); *H01F 2027/406* (2013.01)

(58) Field of Classification Search
USPC ..... 336/105, 107, 210, 192
See application file for complete search history.

(56) References Cited

U.S. PATENT DOCUMENTS

| | | | | |
|---|---|---|---|---|
| 2013/0314964 | A1 | 11/2013 | Yoshikawa | |
| 2014/0085026 | A1* | 3/2014 | Yamada | H01F 27/02 336/90 |
| 2014/0133204 | A1* | 5/2014 | Yoshikawa | H01F 27/06 363/131 |
| 2014/0292456 | A1* | 10/2014 | Suzuki | H01F 27/263 336/55 |
| 2015/0365015 | A1* | 12/2015 | Ito | H01F 37/00 363/131 |

FOREIGN PATENT DOCUMENTS

| | | | |
|---|---|---|---|
| JP | 2010-186766 | A | 8/2010 |
| JP | 2012-084674 | A | 4/2012 |
| JP | 2013-222813 | A | 10/2013 |
| JP | 2015-070140 | A | 4/2015 |

* cited by examiner

2 : 2A, 2B, 2R

REACTOR

TECHNICAL FIELD

The present disclosure relates to a reactor.

This application claims priority to Japanese Patent Application No. 2016-013754 flied on Jan. 27, 2016, the entire contents of which are incorporated herein by reference.

BACKGROUND ART

Patent Document 1 discloses a reactor including an assembly obtained by combining a coil that has a pair of winding portions and a magnetic core, a part of which is arranged inside the winding portions, and a sensor assembly that acquires information regarding a physical value (typically, temperature information) related to the reactor and outputs the information to an external device. The sensor assembly includes a sensor main body that detects a physical value, a wiring portion extending from the sensor main body, and a connector portion for electrically connecting the sensor main body to an external device. According to the reactor of Patent Document 1, the sensor main body is fixed in a space between the pair of winding portions by the sensor holder, and a lead wire (the wiring portion) is caught on a clip-like catch portion formed on a bobbin (an end surface interposed member). The end surface interposed member is a member made of an insulating resin for ensuring insulation between the end surfaces of the winding portions of the coil and the magnetic core.

CITATION LIST

Patent Document

Patent Document 1: JP 2010-186766A

SUMMARY

An aspect of the present disclosure is directed to a reactor including:

an assembly that has a coil that has a pair of winding portions that are arranged side by side, and a magnetic core;

a base member that has a mount plate on which the assembly is mounted; and a sensor assembly that has a sensor main body that detects a physical value related to the reactor, and a wiring portion extending from the sensor main body, wherein the reactor includes a wire catch member provided on the assembly or the base member, the wire catch member allowing a part of the wiring portion to be arranged thereon, and a cable tie for fixing the wiring portion to the wire catch member.

DESCRIPTION OF EMBODIMENTS

Figure 1:
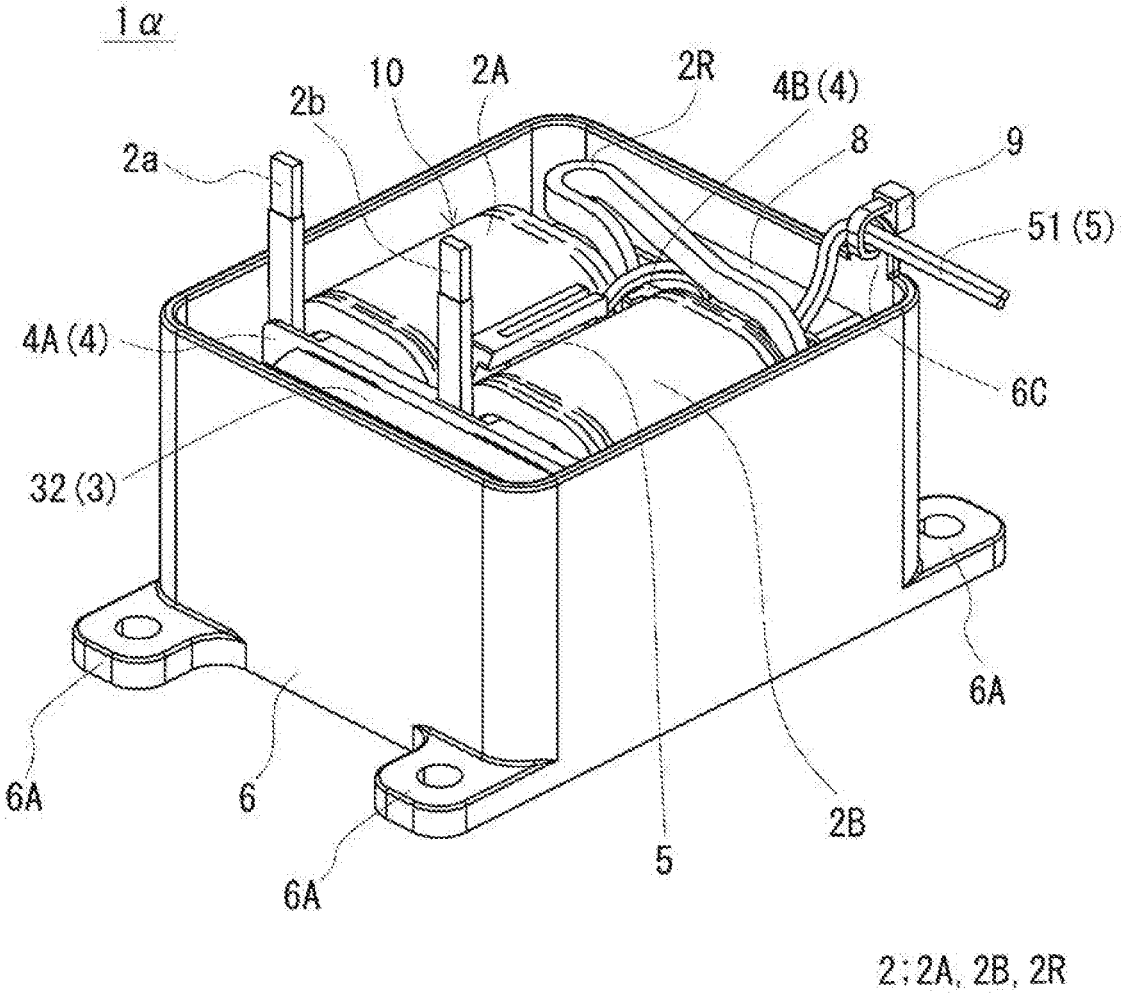
FIG. 1 is a schematic perspective view of a reactor shown in Embodiment 1.

Problem to be Solved by the Present Disclosure

According to the configuration of Patent Document 1, a catch portion is formed in the shape of a cantilevered arm, and a wiring portion is sandwiched under the elasticity of the catch portion. Thus, if vibrations in the reactor are large, the wiring portion may come loose from the catch portion.

Thus, an object of the present disclosure is to provide a reactor in which a wiring portion can be reliably fixed with a simple configuration.

Advantageous Effects of the Present Disclosure

According to a reactor of the present disclosure, a wiring portion is fastened to a wire catch member by a cable tie, and thus it is possible to fix the wiring portion more reliably than in a conventional configuration.

Description of Embodiments

First, embodiments will be listed and described.

<1> An embodiment is directed to a reactor including:

an assembly that has a coil that has a pair of winding portions that are arranged side by side, and a magnetic core, a part of which is arranged inside the winding portions;

a base member that has a mount plate on which the assembly is mounted; and a sensor assembly that has a sensor main body that detects a physical value related to the reactor, and a wiring portion extending from the sensor main body;

wherein the reactor includes a wire catch member provided on the assembly or the base member, the wire catch member allowing a part of the wiring portion to be arranged thereon, and a cable tie for fixing the wiring portion to the wire catch member.

According to this reactor, a wiring portion is fastened to a wire catch member by a cable tie, and thus it is possible to fix the wiring portion more reliably than in a conventional configuration. Furthermore, since a cable tie is used, the configuration of the wire catch member can be simplified, and thus it is possible to suppress a decrease in the productivity of reactors due to forming wire catch members.

<2> The reactor according to an embodiment may be such that the base member is a bottomed casing that has a bottom plate portion constituted by the mount plate, and a side wall portion surrounding the assembly, and the wire catch member is integrally provided on an opening edge of the casing.

Since a wire catch member is formed on the casing, it is possible to use a conventionally used assembly without changing the configuration of the assembly.

<3> The reactor according to an embodiment may be such that the reactor further includes a stay for holding down an upper surface of an outer core portion of the magnetic core, the outer core portion being arranged on an outer side of the winding portions, thereby fixing the assembly to the base member, wherein the wire catch member is a member separate from the stay, and is fastened, together with the stay, to the base member by a screw.

Since a wire catch member that is fastened, together with the stay, to the base portion by a screw is used, it is possible to use a conventionally used assembly without changing the configuration of the assembly.

<4> The reactor according to an embodiment may be such that the reactor further includes a stay for holding down an upper surface of an outer core portion of the magnetic core, the outer core portion being arranged on an outer side of the winding portions, thereby fixing the assembly to the base member, wherein the wire catch member is formed by making a part of the stay protrude outward from the assembly.

Since a wire catch member is formed on the stay, it is possible to use a conventionally used assembly without changing the configuration of the assembly.

<5> The reactor according to an embodiment may be such that the reactor further includes an insulating end surface interposed member interposed between an outer core portion of the magnetic core, the outer core portion being arranged on an outer side of the winding portions, and an end surface of the coil, wherein the wire catch member is integrally provided on the end surface interposed member.

Since a wire catch member is integrally formed on the end surface interposed member, it is possible to suppress an increase in the number of parts of the reactor. Since the end surface interposed member is made of resin or the like, it is possible to easily form the wire catch member.

Details of Embodiments

Hereinafter, embodiments of the reactor will be described with reference to the drawings. Constituent elements with the same names are denoted by the same reference numerals in the drawings. Note that the present invention is defined by the claims without being limited to these configurations shown in the embodiments, and all modifications in the meaning and scope that are equivalent to the claims are intended to be included herein.

Embodiment 1

Overall Configuration

Figure 2:
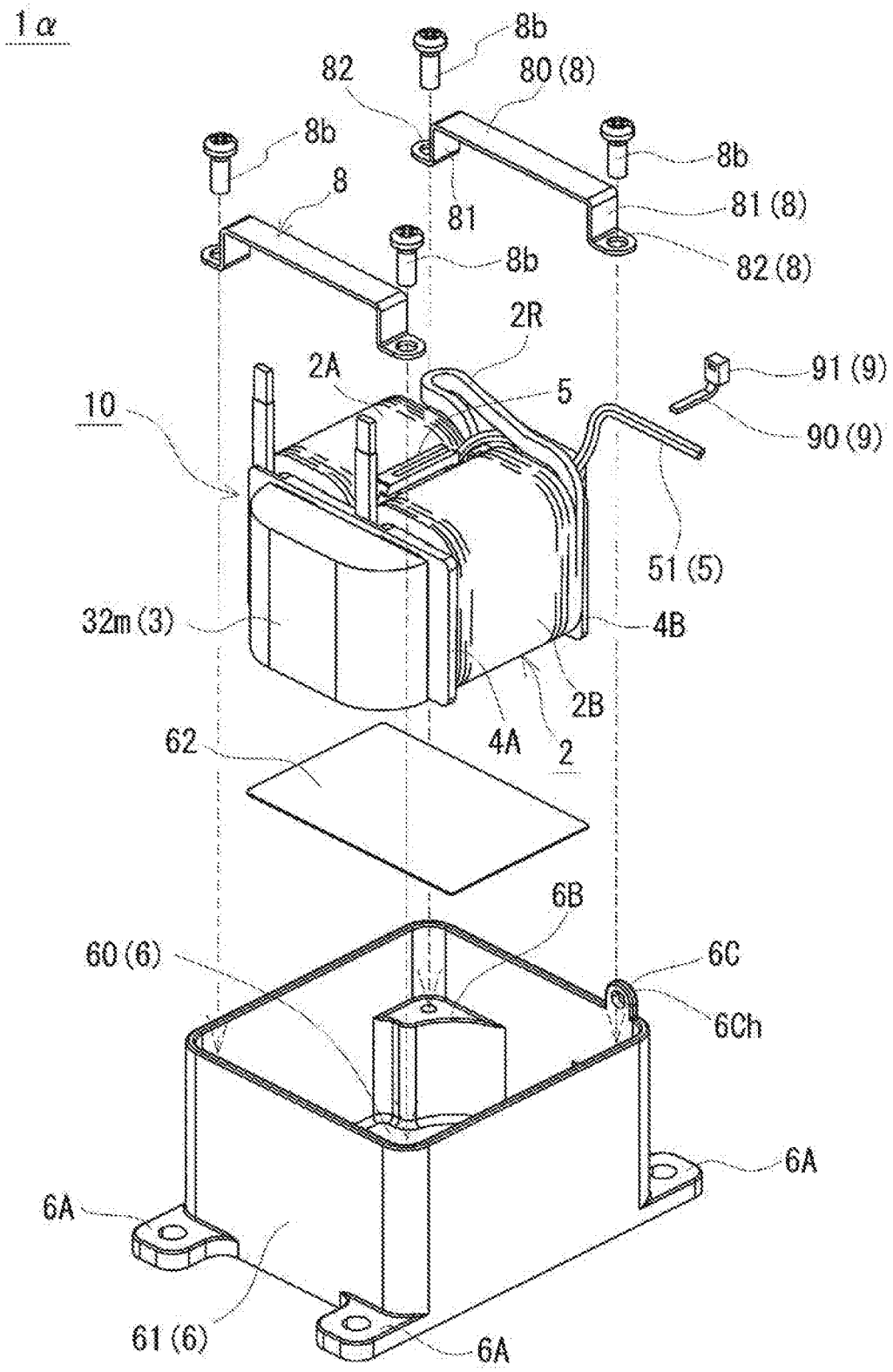
FIG. 2 is an exploded perspective view of the reactor shown in Embodiment 1.

A reactor 1*a* shown in FIGS. 1 and 2 has a configuration in which an assembly 10 including a coil 2 and a magnetic core 3 is accommodated in a casing 6. The reactor 1*a* of this example further includes a sensor assembly 5 that acquires information regarding a physical value related to the reactor 1*a* and outputs the information to an external device. The main difference between the reactor 1*a* of this example and a conventional reactor is that the casing 6 is provided with a wire catch member 6C for fixing a wiring portion 51 of the sensor assembly 5, and the wiring portion 51 is fixed to the wire catch member 6C by a cable tie 9. Hereinafter, aspects of the configuration of the reactor 1*a* will be described in detail.

Assembly

Figure 3:
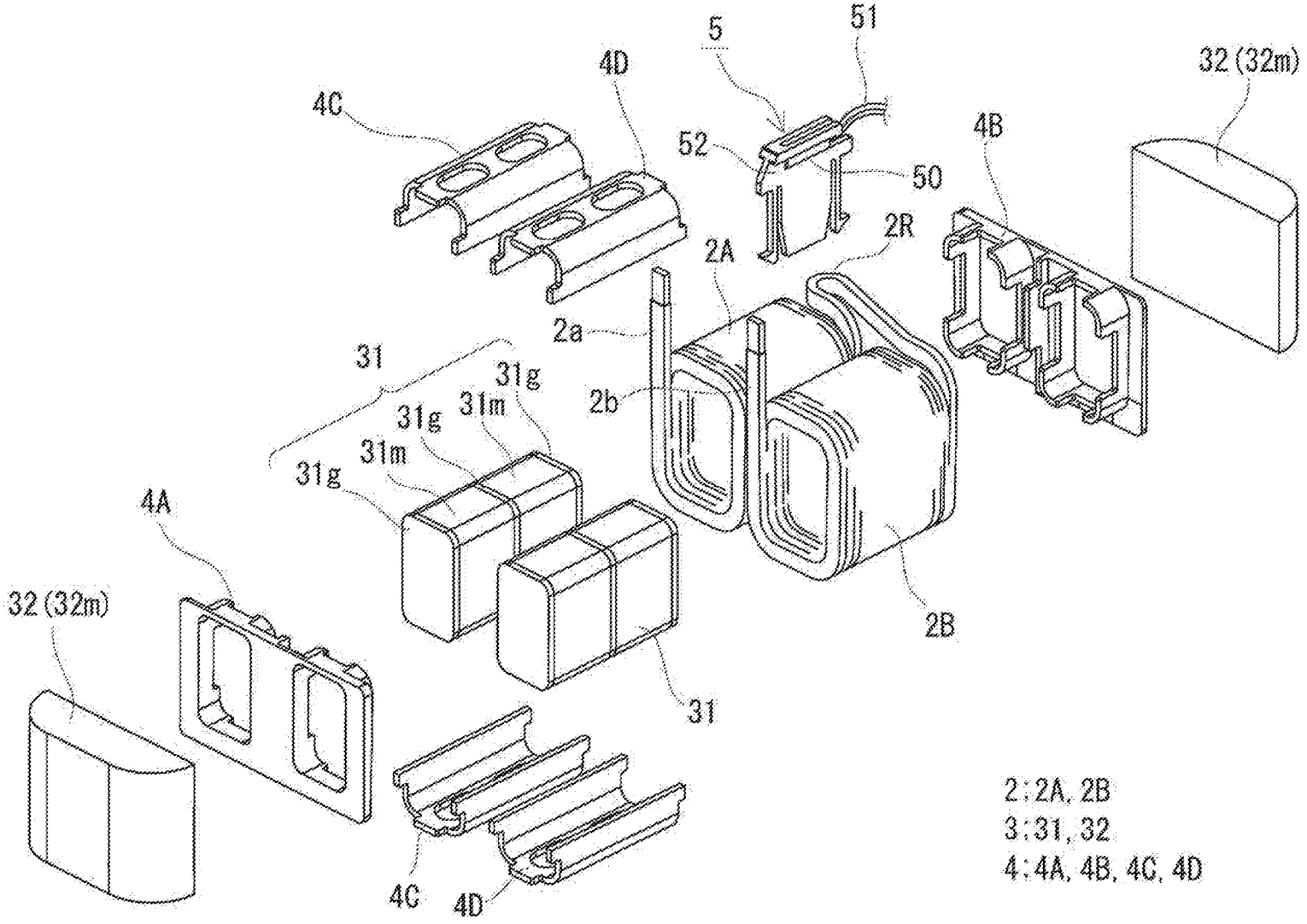
FIG. 3 is an exploded perspective view of an assembly of the reactor shown in Embodiment 1.

The assembly 10 obtained by mechanically combining the coil 2 and the magnetic core 3 may have a known configuration. Below, the assembly 10 will be briefly described with reference to FIG. 3.

Coil

The coil 2 in this embodiment includes a pair of winding portions 2A and 2B, and a connection portion 2R for connecting the two winding portions 2A and 2B. Two ends 2*a* and 2*b* of the coil 2 respectively extend from the winding portions 2A and 2B, and are connected to a terminal member (not shown). An external apparatus such as a power source for supplying power to the coil 2 is connected via this terminal member. The winding portions 2A and 2B included in the coil 2 each have a hollow tubular shape in the same winding direction with the same number of turns, and are arranged side by side such that their axial directions are parallel with each other. Also, the connection portion 2R is bent in a U-shape connecting the two winding portions 2A and 2B. This coil 2 may also be formed by helically winding one winding wire with no joint portion, or may also be formed by producing the winding portions 2A and 2B using separate winding wires and joining ends of the winding wires of the winding portions 2A and 2B through welding or crimping, for example.

The winding portions 2A and 2B of this embodiment each have a rectangular tubular shape. The winding portions 2A and 2B with a rectangular tubular shape are winding portions whose end surfaces have a shape obtained by rounding the corners of a rectangle (which may be a square). It will be appreciated that the winding portions 2A and 2B may also each have a circular tubular shape. Winding portions with a circular tubular shape are winding portions whose end surfaces are in the shape of a closed surface (elliptical shape, perfectly circular shape, race track shape, etc.).

The coil 2 including the winding portions 2A and 2B is constituted by a coated wire including an insulating coating made of an insulating material on the outer periphery of a conductor such as a flat wire or a round wire made of a conductive material such as copper, aluminum, magnesium, or alloys thereof. In this embodiment, the winding portions 2A and 2B are formed by edgewise winding a coated flat wire in which a conductor is constituted by a copper flat wire and an insulating coating is made of an enamel (typically, polyamide imide).

Magnetic Core

There is no particular limitation on the configuration of the magnetic core 3, and the magnetic core 3 may have a known configuration. The magnetic core 3 of this example is formed by combining a plurality of core pieces 31*m*, and can be divided into inner core portions 31 and outer core portions 32, for the sake of convenience.

The inner core portions 31 are portions that are arranged inside the winding portions 2A and 2B of the coil 2. Note that the inner core portions 31 refer to portions of the magnetic core 3 that extend along the axial direction of the winding portions 2A and 2B of the coil 2. For example, in this example, although the ends of those portions extending along the axial direction of the winding portions 2A and 2B project to the outside of the winding portions 2A and 2B past the end surfaces of the winding portions 2A and 2B, the projecting portions are also a part of the inner core portions 31.

Each of the inner core portions 31 of this example is constituted by two core pieces 31*m*, a gap portion 31*g* formed between the core pieces 31*m*, and gap portions 31*g* formed between the core pieces 31*m* and later-described core pieces 32*m*. The shape of the inner core portions 31 is a shape that conforms to the shape of the interior of the winding portion 2A (2B), and in the case of this example, it is a roughly cuboid shape.

Meanwhile, the outer core portions 32 are portions that are arranged outside the winding portions 2A and 2B, and have shapes such that they connect the ends of the pair of inner core portions 31. The outer core portions 32 of this example are constituted by column-shaped core pieces 32*m* whose upper surfaces and lower surfaces are approximately dome-shaped. The lower surfaces of the outer core portions 32 (lower surfaces of the core pieces 32*m*) are approximately level with the lower surfaces of the winding portions 2A and 2B of the coil 2.

The core pieces 31*m* and 32*m* are powder compacts that are obtained by compression molding a raw material powder containing a soft magnetic powder. The soft magnetic powder is an aggregate of magnetic particles constituted by iron-group metals such as iron or an alloy thereof (an Fe—Si alloy, an Fe—Ni alloy, etc.). A lubricant may be contained in the raw material powder. Contrary to this example, the core pieces 31*m* and 32*m* may also be constituted by compacts of a composite material containing a soft magnetic powder and a resin. The soft magnetic powder and the resin for the composite material may be the same soft magnetic powder and resin as those for the powder compacts. An insulation covering made of a phosphate or the like may be formed on the surface of the magnetic particles.

Insulating Interposed Member

An insulating interposed member 4 is a member that ensures insulation between the coil 2 and the magnetic core 3, and is constituted by end surface interposed members 4A and 4B and inner interposed members 4C and 4D. The end surface interposed members 4A and 4B ensure insulation between the end surfaces of the winding portions 2A and 2B and the outer core portions 32. Meanwhile, the inner interposed members 4C and 4D ensure insulation between the inner peripheral faces of the winding portions 2A and 2B and the inner core portions 31. The configurations of the interposed members 4A to 4D are not limited to those shown in the drawings, and may be known configurations. For example, the end surface interposed member 4A (4B) of this example has a shape obtained by connecting two frames that respectively have insertions holes into which the inner core portions 31 are inserted, and the inner interposed member 4C (4D) of this example is formed by combining a pair of gutter-like members. Note that the split state of the insulating interposed member 4 is not limited to the split state shown in this example. For example, an insulating interposed member 4 may be formed by combining a member in which the end surface interposed member 4A and the inner interposed members 4C and 4D are integrated, and the end surface interposed member 4B. Note that, if the magnetic core 3 is constituted by a compact of a composite material, the insulating interposed member 4 does not have to be provided.

Examples of the resin for forming the insulating interposed member 4 include thermoplastic resins such as a polyphenylenesulfide (PPS) resin, a polytetrafluoroethylene (PTFE) resin, a liquid crystal polymer (LCP), a polyamide (PA) resin such as Nylon 6 or Nylon 66, a polybutylene terephthalate (PBT) resin, and an acrylonitrile-butadiene-styrene (ABS) resin. Other examples of the resin for forming the insulating interposed member 4 include thermosetting resins such as an unsaturated polyester resin, an epoxy resin, a urethane resin, and a silicone resin. It is also possible to improve the heat dissipation properties of the insulating interposed member 4 by mixing a ceramic filler into these resins. Examples of the ceramic filler include non-magnetic powders such as alumina or silica.

Sensor Assembly

The sensor assembly 5 is a member that acquires information regarding a physical value related to the reactor 1*a* and outputs the information to an external device. Examples of the physical value include a temperature of the reactor 1*a* in accordance with the application of electricity, acceleration that is an indicator of the vibration level, and the like. The sensor assembly 5 of this example is a member that acquires information regarding the temperature of the assembly 10 (in particular, the temperature of the coil 2).

The sensor assembly 5 includes a sensor main body 50 that has an element that actually detects the temperature, the wiring portion 51 extending from the sensor main body 50, and an unshown connector portion provided at an end of the wiring portion 51. Furthermore, the sensor assembly 5 includes a sensor holder 52 for fixing the sensor main body 50 to the assembly 10.

The sensor assembly 5 may have a known configuration. For example, the sensor holder 52 of the sensor assembly 5 of this example has a plate-like portion that can be inserted into a space between the winding portions 2A and 2B of the coil 2, and the sensor main body 50 can be held in the plate-like portion. Thus, when the plate-like portion of the sensor holder 52 holding the sensor main body 50 is inserted into a space between the winding portions 2A and 2B, the sensor main body 50 can be arranged between the winding portions 2A and 2B. The sensor holder 52 of this example is provided with a pair of elastic leg pieces such that the plate-like portion is interposed therebetween, and claws formed at the ends of the elastic leg pieces engage with a part of the end surface interposed members 4A and 4B. An adhesive, an adhesive sheet, or the like may be used to fix the sensor holder 52 to the winding portions 2A and 2B.

Casing

As shown in FIG. 2, the casing (base member) 6 is a bottomed box-like member constituted by a bottom plate portion (mount plate) 60 and a side wall portion 61, and the assembly 10 is accommodated in the casing 6. The casing 6 of this example is provided with four fixing portions 6A (only three of which are seen in the drawing) protruding outward from the casing 6, and four base portions 6B (only one of which is seen in the drawing) formed inside the casing 6. The fixing portions 6A are members for fixing the casing 6 to an installation target such as a cooling base, and, in this example, screw holes are formed therethrough. Meanwhile, the base portions 6B are bases to which stays 8 are fastened by screws when fixing the assembly 10 to the casing 6 using the stays 8. The height of the base portions 6B may be changed in accordance with the height and the shape of the assembly 10 or the shape of the stays 8.

The casing 6 is required to serve to release heat generated in the assembly 10 while the reactor 1*a* is in use to the installation target, in addition to protecting the assembly 10. Thus, the casing 6 is required to have excellent heat dissipation properties in addition to mechanical strength. In order to meet these requirements, the casing 6 is preferably made of metal. For example, aluminum and alloys thereof and magnesium and alloys thereof can be used as the material for forming the casing 6. These metals (alloys) have advantages of being excellent in terms of mechanical strength and thermal conductivity, lightweight, and non-magnetic.

A joint layer 62 is interposed between the bottom plate portion 60 of the casing 6 and the assembly 10, the joint layer 62 joining the bottom plate portion 60 and the assembly 10. The joint layer 62 also has the function of conducting heat generated in the assembly 10 while the reactor 1*a* is in use to the bottom plate portion 60. A material that has insulating properties is used as the material for forming the joint layer 62. Examples thereof include thermosetting resins such as epoxy resins, silicone resins, and unsaturated polyesters and thermoplastic resins such as PPS resins and LCPs. It is also possible to improve the heat dissipation properties of the joint layer 62 by mixing the above-described ceramic filler or the like into these insulating resins. The joint layer 62 has a thermal conductivity of, for example, preferably 0.1 W/m·K or more, more preferably 1 W/m·K or more, and particularly preferably 2 W/m·K or more.

The joint layer 62 may be formed by applying an insulating resin (which may be a resin containing a ceramic filler) onto the bottom plate portion 60, or may be formed by bonding a sheet material made of an insulating resin onto the bottom plate portion 60 as shown in the drawing. The use of a sheet-like material as the joint layer 62 is preferable because this makes it easy to form the joint layer 62 on the bottom plate portion 60.

Furthermore, in this example, the wire catch member 6C is formed at the opening edge of the casing 6, that is, at the upper end of the side wall portion 61. The wire catch member 6C is a plate-like piece formed by making a part of the side wall portion 61 project upward (the direction in which the side wall portion 61 is provided standing upright), and has a through hole 6Ch through which a later-described cable-like member 90 of the cable tie 9 can be inserted. Since the wire catch member 6C has a simple shape, it can be integrally formed at the side wall portion 61 of the casing 6.

Stays

The stays 8 are members for holding down the upper surfaces of the outer core portions 32 of the magnetic core 3, thereby fixing the assembly 10 to the casing 6. There is no particular limitation on the configuration of the stays 8, and the stays 8 may have a known configuration. Each of the stays 8 of this example is formed in the shape of an overbridge including an upper piece 80 that is brought into contact with the upper surface of the outer core portion 32 and roughly L-shaped leg pieces 81 provided at both ends of the upper piece 80. The portions of the leg pieces 81 substantially parallel to the upper piece 80 are provided with screw holes 82. It is possible to fix the assembly 10 to the casing 6, by bringing the upper pieces 80 of the stays 8 into contact with the upper surfaces of the outer core portions 32, and fastening the leg pieces 81 of the stays 8 to the base portions 6B of the casing 6 using screws 8*b*.

Cable Tie

The cable tie 9 includes the cable-like member 90 made of resin or the like, and a locking piece 91 formed at one end of the cable-like member 90. In this example, it is possible to fasten the wiring portion 51 to the wire catch member 6C using the cable-like member 90, by inserting the other end of the cable-like member 90 into the through hole 6Ch of the wire catch member 6C, wrapping the cable-like member 90 around the outer periphery of the wiring portion 51, and then inserting the other end into the hole of the locking piece 91 and pulling the other end.

As the cable tie 9, commercially available products may be used. For example, Insulok Tie (registered trademark) manufactured by HellermannTyton Co., Ltd., Ty-Rap (registered trademark) manufactured by Thomas & Betts, and the like may be used as the cable tie 9.

Effects of Reactor

According to the reactor 1α of Embodiment 1, the wiring portion 51 is fixed to the wire catch member 6C using the cable tie 9. It is easy to perform the operation to fix the wiring portion 51 using the cable tie 9. Furthermore, once the cable tie 9 is tightened around an object, it is very difficult to undo the tightening, and thus the wiring portion 51 will not come loose from the wire catch member 6C with the degree of vibrations or the like that occur while the reactor 1*a* is in use.

Embodiment 2

Figure 4:
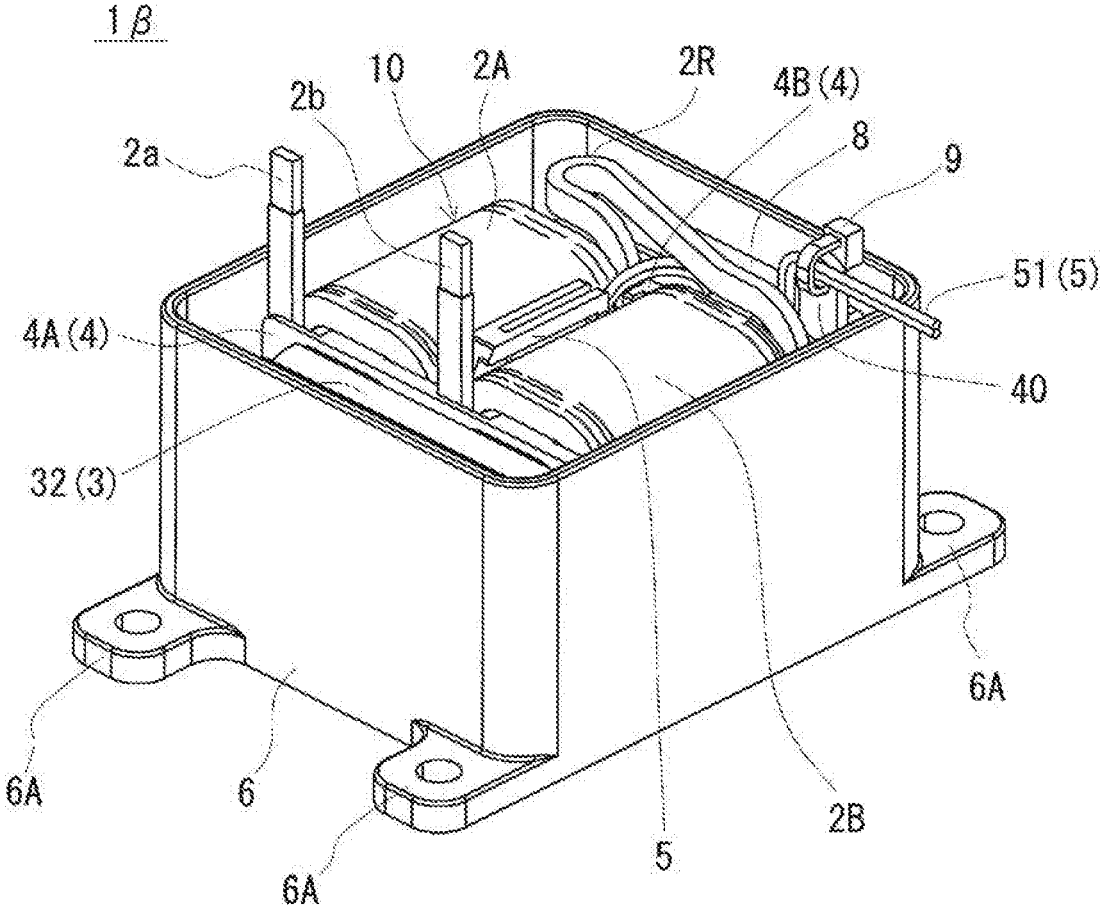
FIG. 4 is a schematic perspective view of a reactor shown in Embodiment 2.
Figure 5:
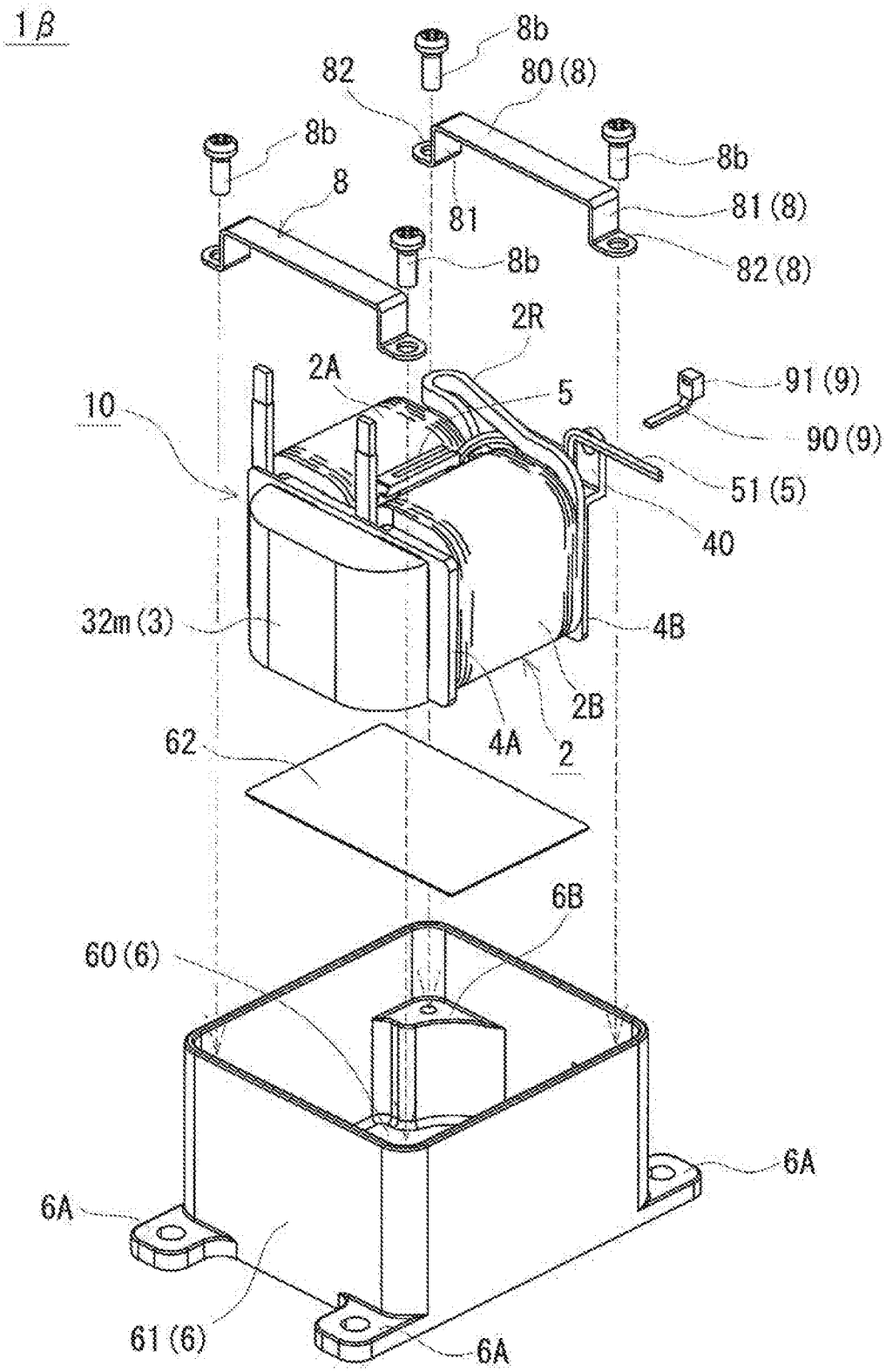
FIG. 5 is an exploded perspective view of the reactor shown in Embodiment 2.

In Embodiment 2, a reactor 1β in which one end surface interposed member 4B is provided with a wire catch member 40 will be described with reference to FIGS. 4 to 6.

Figure 6:
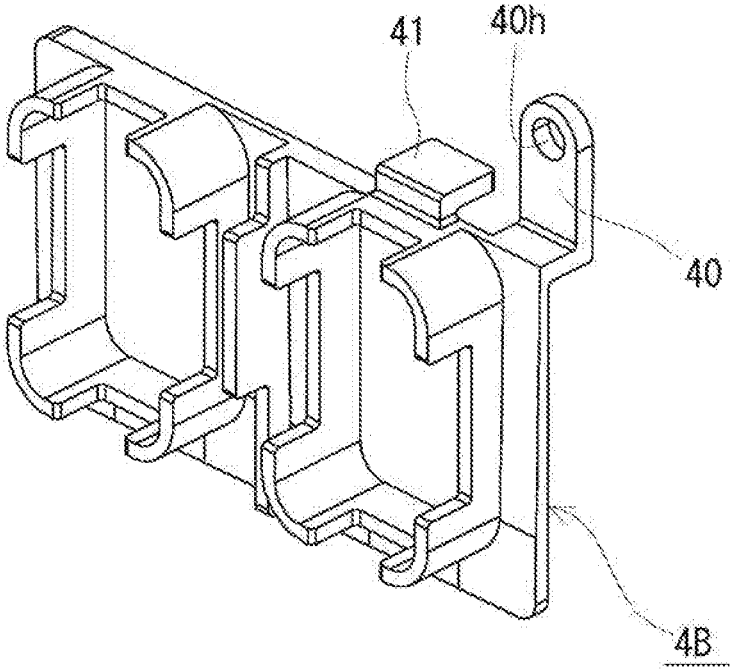
FIG. 6 is a schematic perspective view of an end surface interposed member included in the reactor shown in Embodiment 2.
Figure 6:
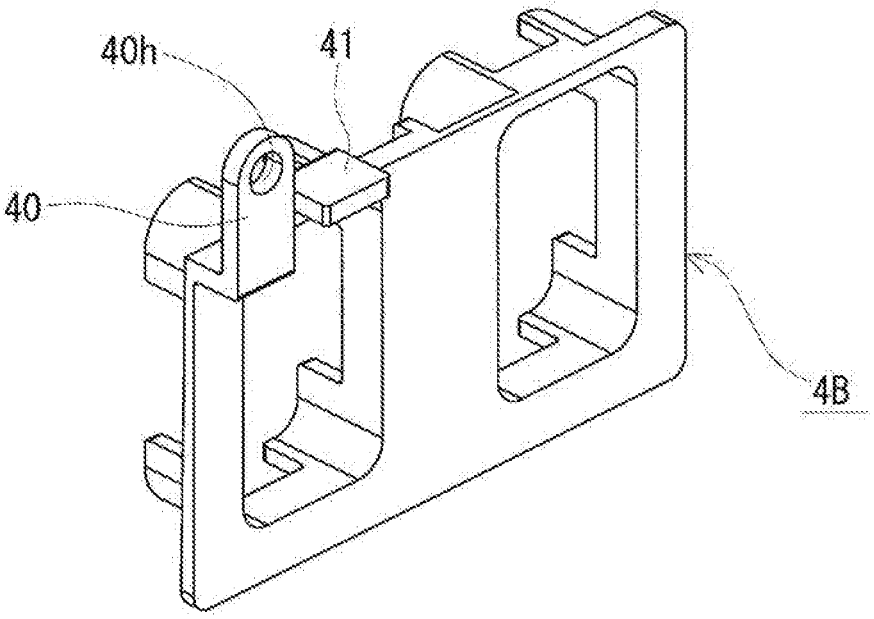

As shown in FIG. 6, the end surface interposed member 4B of this example includes the wire catch member 40, at an end in the width direction (end on the winding portion 2B side in FIGS. 4 and 5) on the upper end of the end surface interposed member 4B. The wire catch member 40 is an L-shaped plate-like piece constituted by a root portion extending in a direction away from the winding portion 2B (FIGS. 4 and 5) along the axial direction of the winding portion 2B, and a base portion extending from the end of the root portion to a position above the assembly 10 (FIGS. 4 and 5). The portion of the wire catch member 40 extending to a position above the assembly 10 is provided with a through hole 40*h*. As in Embodiment 1, the through hole 40*h* is provided in order to allow the cable-like member 90 of the cable tie 9 to be inserted therethrough when fixing the wiring portion 51 to the wire catch member 40.

The end surface interposed member 4B of this example includes, in addition to the wire catch member 40, a guide portion 41 for guiding the wiring portion 51 (FIGS. 4 and 5) to the wire catch member 40. The guide portion 41 is formed in the shape of an eave protruding in a direction away from the winding portion 2B (FIGS. 4 and 5) along the axial direction of the winding portion 2B. When the wiring portion 51 (FIGS. 4 and 5) is arranged along the lower surface of the guide portion 41, the wiring portion 51 can be guided to the wire catch member 40. Note that the guide portion 41 may be provided also on the end surface interposed member 4B of Embodiment 1 or the end surface interposed member 4B of Embodiments 3 and 4, which will be described later.

The wire catch member 40 and the guide portion 41 described above can be integrally formed on the end surface interposed member 4B through resin molding.

Also in the configuration of Embodiment 2, it is possible to fasten the wiring portion 51 to the wire catch member 40 using the cable-like member 90, by inserting the other end of the cable-like member 90 into the through hole 40*h* of the wire catch member 40, wrapping the cable-like member 90 around the outer periphery of the wiring portion 51, and then inserting the other end into the hole of the locking piece 91 and pulling the other end.

Embodiment 3

Figure 7:
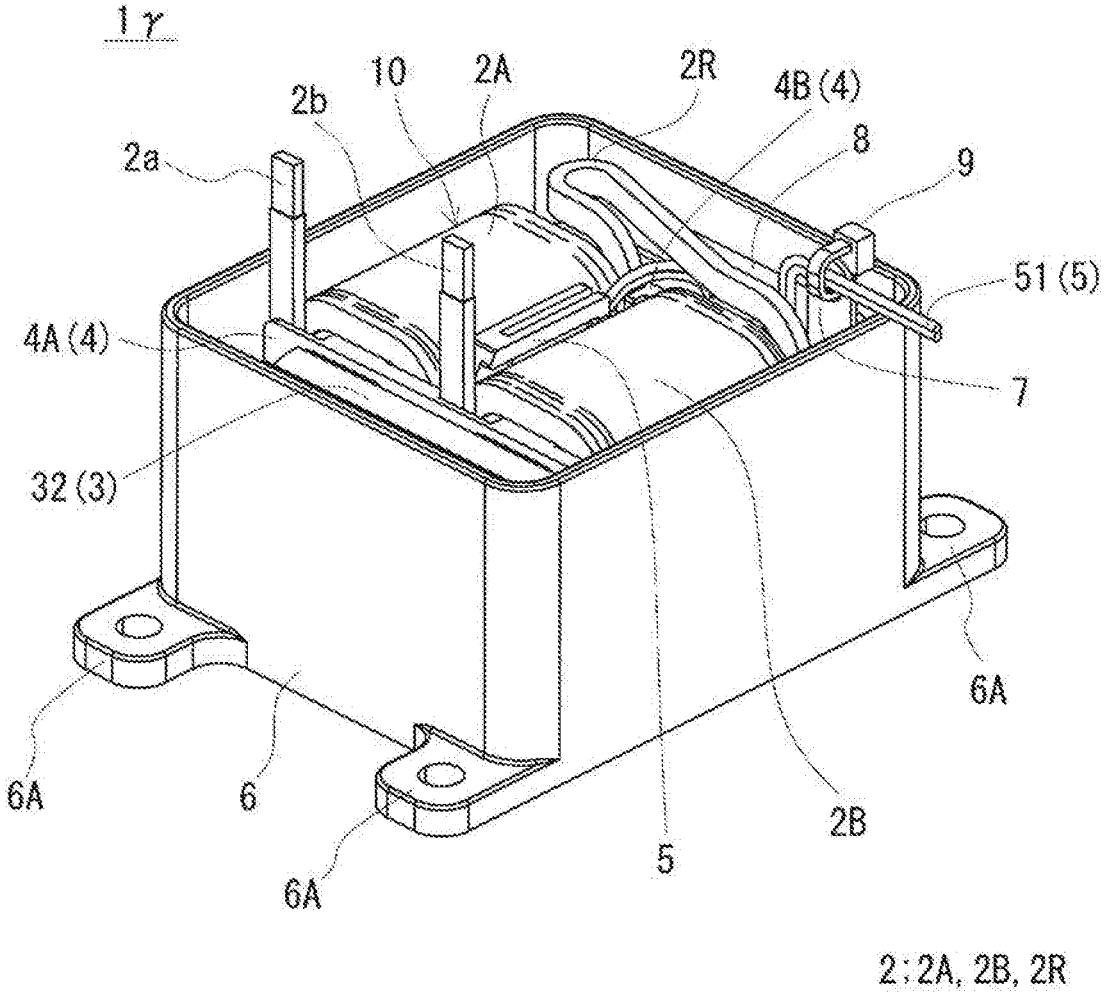
FIG. 7 is a schematic perspective view of a reactor shown in Embodiment 3.

In Embodiment 3, a reactor 1γ in which a catch piece (wire catch member) 7 prepared separately from the stays 8 is used will be described with reference to FIGS. 7 and 8.

Figure 8:
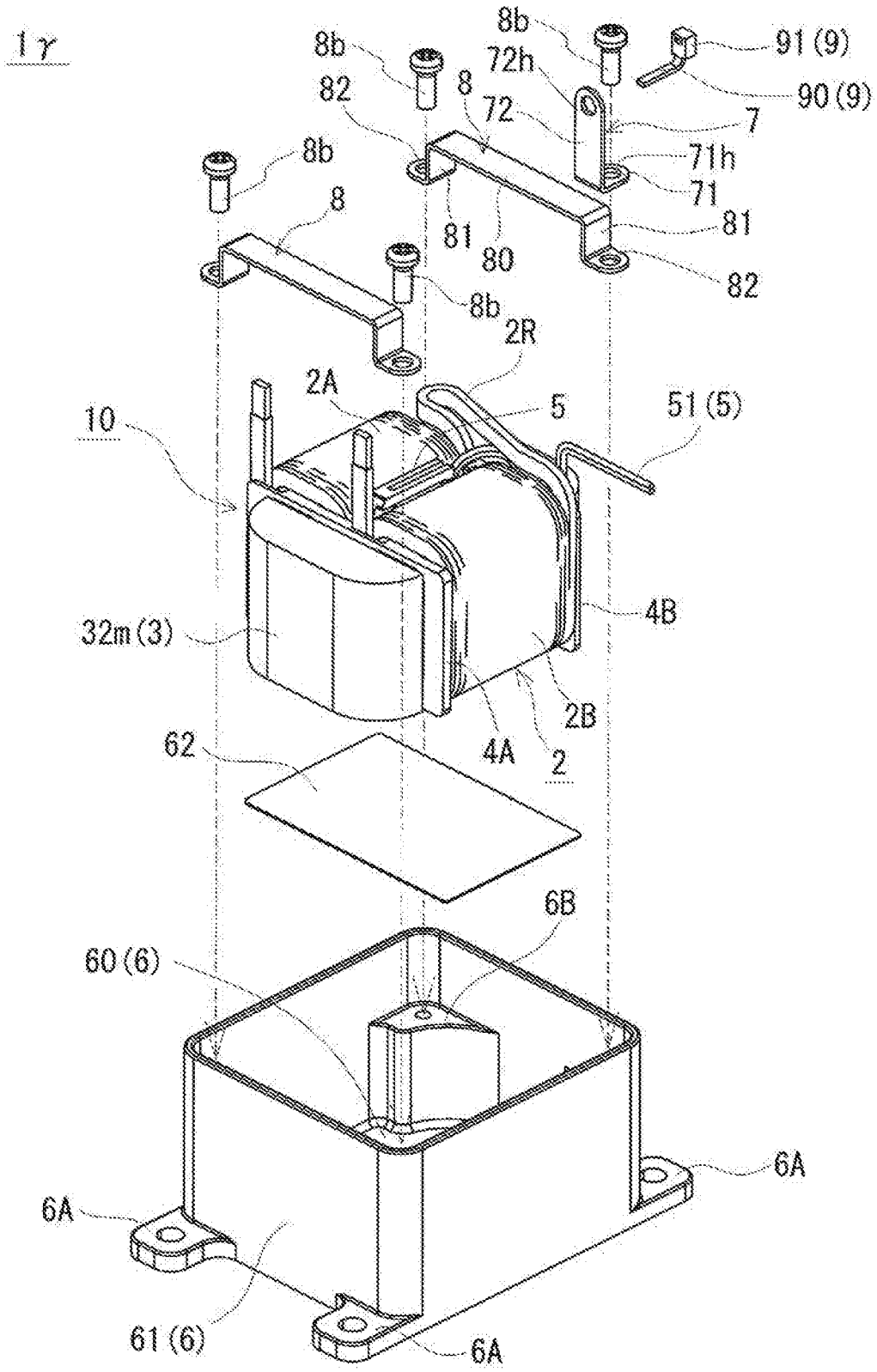
FIG. 8 is an exploded perspective view of the reactor shown in Embodiment 3.

As shown in FIG. 8, the catch piece 7 is a roughly L-shaped member including a leg piece 71 and a base piece 72. The leg piece 71 is provided with a screw hole 71*h* into which a screw 8*b* for fixing a stay 8 is inserted. Meanwhile, the base piece 72 is provided with a through hole 72*h* that is used to fix the wiring portion 51 using the cable tie 9. The base piece 72 preferably has a length that allows the through hole 72*h* to be arranged above the opening of the casing 6. With this configuration, it is easy to attach the cable tie 9 to the through hole 72*h*.

The catch piece 7 is fixed, together with the stay 8, to the casing 6 by the screw 8*b*. Specifically, the leg piece 71 of the catch piece 7 is placed on a leg piece 81 of the stay 8 such that the screw hole 71*h* of the catch piece 7 matches a screw hole 82 of the stay 8, and the stay 8 is fastened, together with the catch piece 7, to the base portion 6B of the casing 6 by the screw 8*b*.

Also in the configuration of Embodiment 3, it is possible to fasten the wiring portion 51 to the catch piece 7 using the cable-like member 90, by inserting the other end of the cable-like member 90 into the through hole 72*h* of the catch piece (wire catch member) 7, wrapping the cable-like member 90 around the outer periphery of the wiring portion 51, and then inserting the other end into the hole of the locking piece 91 and pulling the other end. Since the catch piece 7 is fastened to the casing 6 by a screw, the wiring portion 51 fastened to the catch piece 7 is reliably fixed to the casing 6.

Embodiment 4

Figure 9:
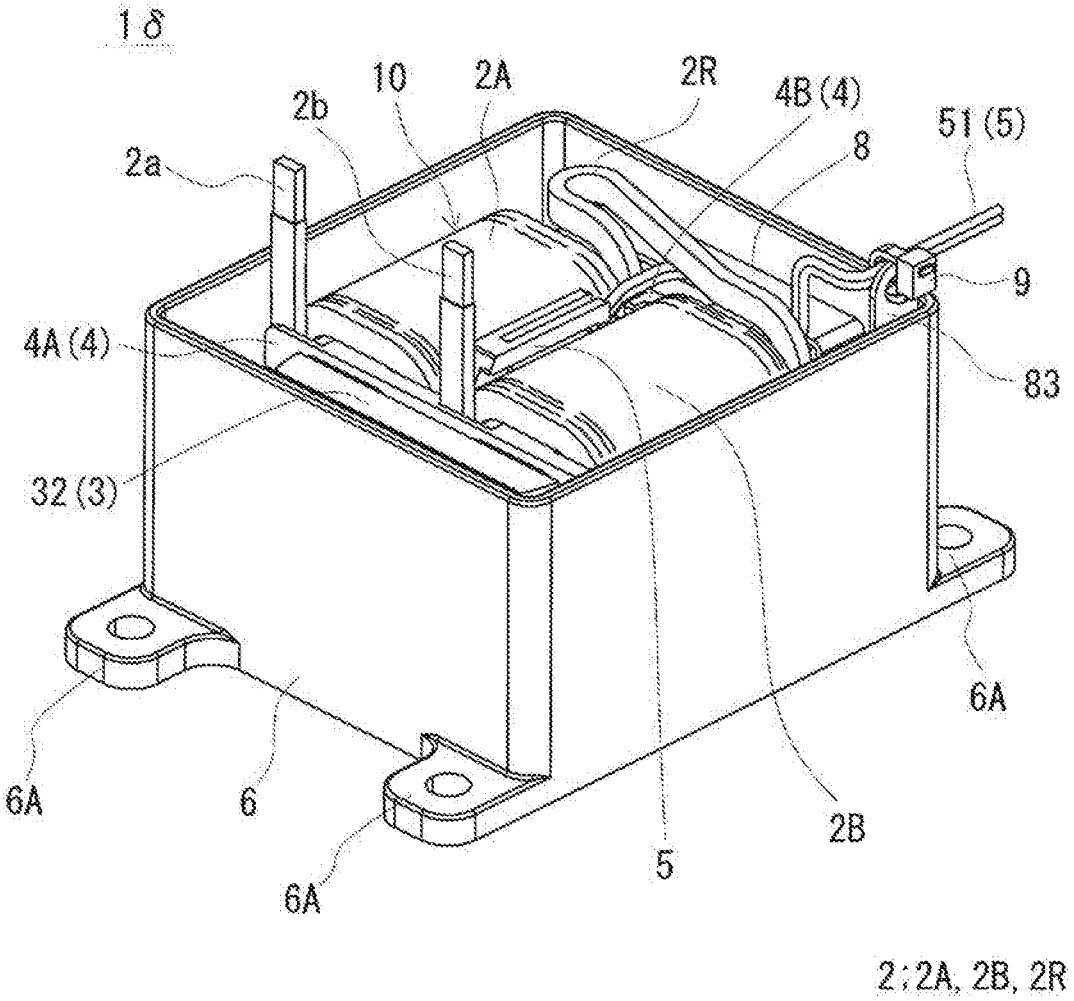
FIG. 9 is a schematic perspective view of a reactor shown in Embodiment 4.

In Embodiment 4, a reactor 1δ in which one stay 8 is provided with a wire catch member 83 will be described with reference to FIGS. 9 and 10.

Figure 10:
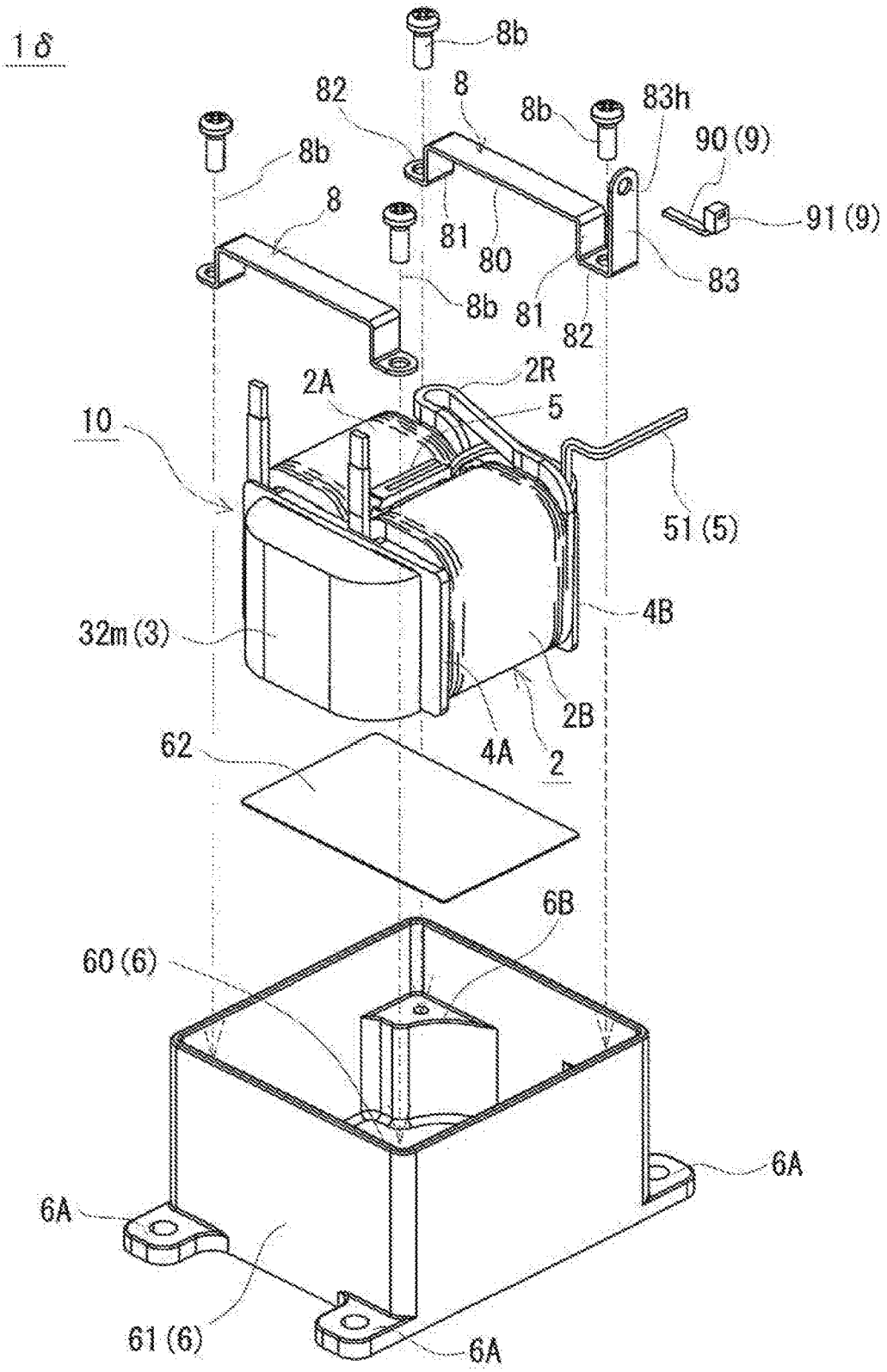
FIG. 10 is an exploded perspective view of the reactor shown in Embodiment 4.

As shown in FIG. 10, the stay 8 of this example includes, in addition to the upper piece 80 and the pair of leg pieces 81, the wire catch member 83 extending from an end of one of the leg pieces 81 to a position above the assembly 10. An end of the wire catch member 83 is provided with a through hole 83*h*.

Also in the configuration of Embodiment 4, it is possible to fasten the wiring portion 51 to the wire catch member 83 using the cable-like member 90, by inserting the other end of the cable-like member 90 into the through hole 83*h* of the wire catch member 83, wrapping the cable-like member 90 around the outer periphery of the wiring portion 51, and then inserting the other end into the hole of the locking piece 91 and pulling the other end.

Embodiment 5

Contrary to the configurations of Embodiments 1 to 4, a configuration is also possible in which the reactor does not include the casing 6. For example, a wire fixing structure using a cable tie may be applied to a reactor in which an assembly is arranged on a mount plate. In that case, it is sufficient that a stay with long leg pieces is used and the leg pieces of the stay are fastened to the mount plate by screws.

Applications

The reactor according to an embodiment of the present invention can be used in power conversion apparatuses such as a two-way DC-DC converter that is to be mounted in an electric motor vehicle such as a hybrid car, an electric automobile, or a fuel-cell vehicle.

LIST OF REFERENCE NUMERALS

1α, 1β, 1γ, 1δ Reactor
10 Assembly
2 Coil
2A, 2B Winding portion
2R Connection portion
2*a*, 2*b* End
3 Magnetic core
31 Inner core portion
31*m* Core piece
31*g* Gap portion
32 Outer core portion
32*m* Core piece
4 Insulating interposed member
40 Wire catch member
40*h* Through hole
41 Guide portion
4A, 4B End surface interposed member
4C, 4D Inner portion interposed member
5 Sensor assembly
50 Sensor main body
51 Wiring portion
52 Sensor holder
6 Casing (base member)
60 Bottom plate portion (mount plate)
61 Side wall portion
62 Joint layer
6A Fixing portion
6B Base portion
6C Wire catch member
6Ch Through hole
7 Catch piece (wire catch member)
71 Leg piece
71*h* Screw hole
72 Base piece
72*h* Through hole
8 Stay
8*b* Screw
80 Upper piece
81 Leg piece
82 Screw hole
83 Wire catch member
83*h* Through hole
9 Cable tie
90 Cable-like member
91 Locking piece

The invention claimed is:

1. A reactor comprising:

an assembly that has a coil that has a pair of winding portions that are arranged side by side, and a magnetic core, a part of which is arranged inside the winding portions;

a base member that has a mount plate on which the assembly is mounted; and a sensor assembly that has a sensor main body that detects a physical value related to the reactor, and a wiring portion extending from the sensor main body, wherein:

the reactor includes a wire catch member provided on the assembly or the base member, the wire catch member allowing a part of the wiring portion to be arranged thereon, and a cable tie that includes a cable-like member and a locking piece formed at one end of the cable-like member, and fixes the wiring portion to the wire catch member, the base member is a bottomed casing that has a bottom plate portion constituted by the mount plate, and a side wall portion surrounding the assembly, the wire catch member is integrally provided on an opening edge of the casing, and includes a plate-like piece projecting upward from the side wall portion, and a through hole formed through the plate-like piece, and the wiring portion is fixed to the wire catch member by inserting another end of the cable-like member of the cable tie into the through hole of the wire catch member, wrapping the cable-like member around the wiring portion, inserting the another end of the cable-like member into the locking piece, and pulling the another end of the cable-like member.

2. A reactor comprising:

an assembly that has a coil that has a pair of winding portions that are arranged side by side, and a magnetic core, a part of which is arranged inside the winding portions;

a base member that has a mount plate on which the assembly is mounted; and a sensor assembly that has a sensor main body that detects a physical value related to the reactor, and a wiring portion extending from the sensor main body, wherein:

the reactor includes a wire catch member provided on the assembly or the base member, the wire catch member allowing a part of the wiring portion to be arranged thereon, and a cable tie that includes a cable-like member and a locking piece formed at one end of the cable-like member, and fixes the wiring portion to the wire catch member, the reactor further includes a stay for holding down an upper surface of an outer core portion of the magnetic core, the outer core portion being arranged on an outer side of the winding portions, thereby fixing the assembly to the base member, the wire catch member is a member separate from the stay, and is fastened, together with the stay, to the base member by a screw, and the wiring portion is fixed to the wire catch member by inserting another end of the cable-like member of the cable tie into a through hole of the wire catch member, wrapping the cable-like member around the wiring portion, inserting the another end of the cable-like member into the locking piece, and pulling the another end of the cable-like member.

3. A reactor comprising:

an assembly that has a coil that has a pair of winding portions that are arranged side by side, and a magnetic core, a part of which is arranged inside the winding portions;

a base member that has a mount plate on which the assembly is mounted; and a sensor assembly that has a sensor main body that detects a physical value related to the reactor, and a wiring portion extending from the sensor main body, wherein:

the reactor includes a wire catch member provided on the assembly or the base member, the wire catch member allowing a part of the wiring portion to be arranged thereon, and a cable tie that includes a cable-like member and a locking piece formed at one end of the cable-like member, and fixes the wiring portion to the wire catch member, the reactor further includes a stay for holding down an upper surface of an outer core portion of the magnetic core, the outer core portion being arranged on an outer side of the winding portions, thereby fixing the assembly to the base member, the wire catch member is formed by making a part of the stay protrude outward from the assembly, and the wiring portion is fixed to the wire catch member by inserting another end of the cable-like member of the cable tie into a through hole of the wire catch member, wrapping the cable-like member around the wiring portion, inserting the another end of the cable-like member into the locking piece, and pulling the another end of the cable-like member.

4. A reactor comprising:

an assembly that has a coil that has a pair of winding portions that are arranged side by side, and a magnetic core, a part of which is arranged inside the winding portions;

a base member that has a mount plate on which the assembly is mounted; and a sensor assembly that has a sensor main body that detects a physical value related to the reactor, and a wiring portion extending from the sensor main body, wherein:

the reactor includes a wire catch member provided on the assembly or the base member, the wire catch member allowing a part of the wiring portion to be arranged thereon, and a cable tie that includes a cable-like member and a locking piece formed at one end of the cable-like member, and fixes the wiring portion to the wire catch member, the reactor further includes an insulating end surface interposed member interposed between an outer core portion of the magnetic core, the outer core portion being arranged on an outer side of the winding portions, and an end surface of the coil, the wire catch member is integrally provided on the end surface interposed member, and includes a plate-like piece extending to a position above the assembly, and a through hole formed through the plate-like piece, and the wiring portion is fixed to the wire catch member by inserting another end of the cable-like member of the cable tie into the through hole of the wire catch member, wrapping the cable-like member around the wiring portion, inserting the another end of the cable-like member into the locking piece, and pulling the another end of the cable-like member.

* * * * *